US007313940B2

(12) United States Patent
Gomez

(10) Patent No.: US 7,313,940 B2
(45) Date of Patent: Jan. 1, 2008

(54) HIGH-PRESSURE SHAPING SYSTEM

(75) Inventor: Rafael Garcia Gomez, Paderborn (DE)

(73) Assignee: Benteler Automobiltechnik GbmH, Paderborn (DE)

( * ) Notice: Subject to any disclaimer, the term of this patent is extended or adjusted under 35 U.S.C. 154(b) by 0 days.

(21) Appl. No.: 11/603,919

(22) Filed: Nov. 22, 2006

(65) Prior Publication Data

US 2007/0125145 A1 Jun. 7, 2007

(30) Foreign Application Priority Data

Dec. 2, 2005 (DE) ..... 10 2005 057 863

(51) Int. Cl.
*B23P 23/00* (2006.01)
*B21B 37/00* (2006.01)

(52) U.S. Cl. ..... 72/58; 72/55; 72/62

(58) Field of Classification Search ..... 72/55, 72/57, 58, 61, 62

See application file for complete search history.

(56) References Cited

U.S. PATENT DOCUMENTS

| | | | | |
|---|---|---|---|---|
| 3,373,585 | A * | 3/1968 | Reynolds | 72/57 |
| 4,265,102 | A * | 5/1981 | Shimakata et al. | 72/58 |
| 4,362,037 | A * | 12/1982 | Whitfield | 72/52 |
| 5,816,089 | A * | 10/1998 | Marando | 72/55 |
| 6,260,393 | B1 * | 7/2001 | Engel et al. | 72/55 |
| 6,493,913 | B2 * | 12/2002 | Streubel et al. | 29/33 D |
| 6,662,611 | B2 * | 12/2003 | Janssen et al. | 72/55 |
| 7,150,170 | B2 * | 12/2006 | Streubel et al. | 72/57 |

FOREIGN PATENT DOCUMENTS

| | | |
|---|---|---|
| DE | 19624036 | * 12/1997 |
| DE | 19957888 | * 6/2001 |
| DE | 10153600 | * 5/2003 |
| DE | 10202791 | * 8/2003 |
| DE | 10313072 | * 9/2004 |
| EP | 1136149 | * 3/2001 |

* cited by examiner

*Primary Examiner*—David B Jones
(74) *Attorney, Agent, or Firm*—Andrew Wilford

(57) ABSTRACT

A high-pressure system for hydroshaping a hollow workpiece has a lower die and an upper die vertically shiftable above the lower die and forming therewith a cavity shaped to hold the workpiece. An upper actuating element bears downward via a vertically compressible hydraulic operating cylinder on the upper die. A spring-loaded pressure-storing cylinder is connected by a hydraulic line to the operating cylinder and to the workpiece. Downward shifting of the actuating element first closes the dies together, then internally pressurizes the workpiece via the line from the operating cylinder such that the workpiece deforms and shapes itself to the cavity, and then fills the spring-loaded pressure-storing cylinder. Subsequent upward shifting of the actuating element at first allows the pressure-storing cylinder to empty, and then entrains the upper die upward off the workpiece by the actuating element.

5 Claims, 2 Drawing Sheets

HIGH-PRESSURE SHAPING SYSTEM

FIELD OF THE INVENTION

The present invention relates to a high-pressure shaping system. More particularly this invention concerns such a system used to make accurately dimensioned hollow parts.

BACKGROUND OF THE INVENTION

A high-pressure hydraulic system as described in U.S. Pat. No. 6,493,913 for hydroshaping a hollow workpiece has a lower die and an upper die vertically shiftable above the lower die between a lower position engaging the lower die and forming therewith a cavity shaped to hold the workpiece and an upper position spaced above the lower die. A hydraulic cylinder is braced between the upper die and a press actuator that can shift this cylinder and the upper die from its upper position to its lower position. A fluid line is connected between the cylinder and the interior of the workpiece and serves for internally pressurizing the workpiece.

Thus with this system the hollow workpiece is typically fitted to the lower die, its ends are plugged if it is a tube, and it is connected via the pressure line to the upper-die cylinder. The press actuator is then operated to shift down the cylinder and, with it, the upper die until this upper die abuts the lower die, at which time the cylinder is compressed so that pressure increases in it and in the workpiece until the workpiece bulges outward to fit the cavity of the die. Connecting the cylinder and workpiece together with a pressure line ensures that pressure in the workpiece will not rise to dangerous levels until the dies are solidly closed together, and uses a single mechanical actuator to both close the die assembly and pressurize the workpiece.

With this system, a hydraulic locking press is required that as far as its control system is concerned, is designed such that during the hydroshaping process the die assembly is closed for a certain period. The holding time for example for chassis parts such as side members and cross bridges is in the range of 5 to 10 seconds. This results in cycle times in the range of 30 to 40 seconds for producing a finished workpiece including transporting the workpiece to be shaped toward the die assembly as well as transporting the shaped workpiece out of the die assembly.

The pressurizing/control system for the press is provided with electronic and hydraulic pressure controllers, valves, hydraulic pumps, hydraulic cylinders and sensors. Due to the plurality of electrical and hydraulic workpieces, the system is too slow for hydroshaping along with mechanical presses as far as series production is concerned. Additional manufacturing operations on the workpieces, such as punching, stamping or cutting are carried out an additional manufacturing process after the hydroshaping process.

OBJECTS OF THE INVENTION

It is therefore an object of the present invention to provide an improved hydroshaping system.

Another object is the provision of such an improved hydroshaping system that overcomes the above-given disadvantages, in particular that allows a subsequent mechanical operation, such as punching, to be carried out more efficiently.

Yet another object is to provide a simplified system for hydroshaping and also mechanically processing a hollow workpiece.

SUMMARY OF THE INVENTION

A high-pressure system for hydroshaping a hollow workpiece has a lower die and an upper die vertically shiftable above the lower die between a lower closed position engaging the lower die and forming therewith a cavity shaped to hold the workpiece and an upper open position spaced above the lower die. An upper actuating element bears downward via a vertically compressible hydraulic operating cylinder on the upper die. A spring-loaded pressure-storing cylinder is connected by a hydraulic line to the operating cylinder and to the workpiece. Downward shifting of the actuating element first closes the dies together, then internally pressurizes the workpiece via the line from the operating cylinder such that the workpiece deforms and shapes itself to the cavity, and then fills the spring-loaded pressure-storing cylinder. Subsequent upward shifting of the actuating element at first allows the pressure-storing cylinder to empty, and then entrains the upper die upward off the workpiece by the actuating element. A tool mounted on one of the dies is engageable with the workpiece when the dies are closed.

Thus according to the invention, the object of the invention is attained by a pressure control system where the pressure control system is provided with a piston-cylinder-spring-unit serving to store pressure. The high pressure circuit is maintained closed during and after internal high pressure shaping until the press ram has passed its bottom dead-center position, as typically the press ram is operated by a crank. Thus, the pressing time increases and as a result a further manufacturing operation during the press stroke is possible. According to the invention, the press is thus provided with a further device for additional manufacturing operations, e.g. a punch, shear, threader, embosser, or the like.

For assuring perfect fitting of the workpiece into the shaping chamber in the shaping process, the piston-cylinder-unit is designed such that the volume that it displaces is larger than the volume which would be necessary for the shaping, that is the internal volume of the finished workpiece. This excess volume is received by the chamber of the piston-cylinder-spring-unit. The high-pressure chamber of the piston-cylinder-spring-unit and the die assembly are connected by means of a line. The high-pressure chamber is provided with a cylinder, a piston and a seal. The spring attached to the high-pressure side of the high-pressure chamber ensures that only when a sufficient internal pressure is present in the workpiece or within the shaping chamber is the excess volume taken from the piston-cylinder-unit. The pressure corresponds to the pressure which is necessary for completely filling the shaping chamber with the workpiece or for the deforming the tube or plate workpiece to the contours of the shaping chamber. The pressure applied to the piston is countered by a spring and a spring support. This countervailing force prevents the pressure from decreasing immediately as the press ram starts moving back up and builds up a pressure plateau. On the pressure plateau, manufacturing operations such as punching, assembling or cutting are possible. Such a solution is advantageous because of the high pressures in the range of 600 to 3000 bars occurring in hydroshaping since a direct pressure limiting by means of common pressure reducers is not possible in such applications. The limiting of pressure is regulated by the high-pressure chamber of the piston-cylinder-spring-unit. The excess fluid volume is received by the high-pressure chamber during the internal high pressure shaping and thus, the pressure is slightly increased.

By means of the pressure plateau, manufacturing operations can be carried out during or after the hydroshaping operation, that is when the workpiece is deformed to conform to the die cavity. Fabrication operations without external sources of energy are carried out during or after the end of the internal high pressure shaping until shortly after the bottom dead center UT of the press ram is reached. By means of external sources of energy, additional manufacturing operations can be carried out after the bottom dead center UT has been reached beyond the pressure drop point $C_2$ of the pressure level.

In case the hydroshaping process and an additional fabrication operation are carried out simultaneously, the press ram is some millimeters above the bottom dead center UT so that the press ram moves further toward the bottom dead center UT and actuates the device for punching, cutting threads or shearing in a mechanical or hydraulic process. After having passed the bottom dead center, the device for the additional fabrication operation has carried out the additional manufacturing operation such as punching, stamping or thread cutting. Subsequently, the press ram is moved by its crank actuator moves toward the upper dead-center crank position without any time delay. The pressure decreases and the press opens the hydroshaping tool. The hydroshaping and the manufacturing operation are both finished, and the manufacturing operation—punching for example—will have been carried out efficiently on an internally pressurized workpiece, but since it was done in the hydroshaping press, there is no problem controlling the enormous internal pressure.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
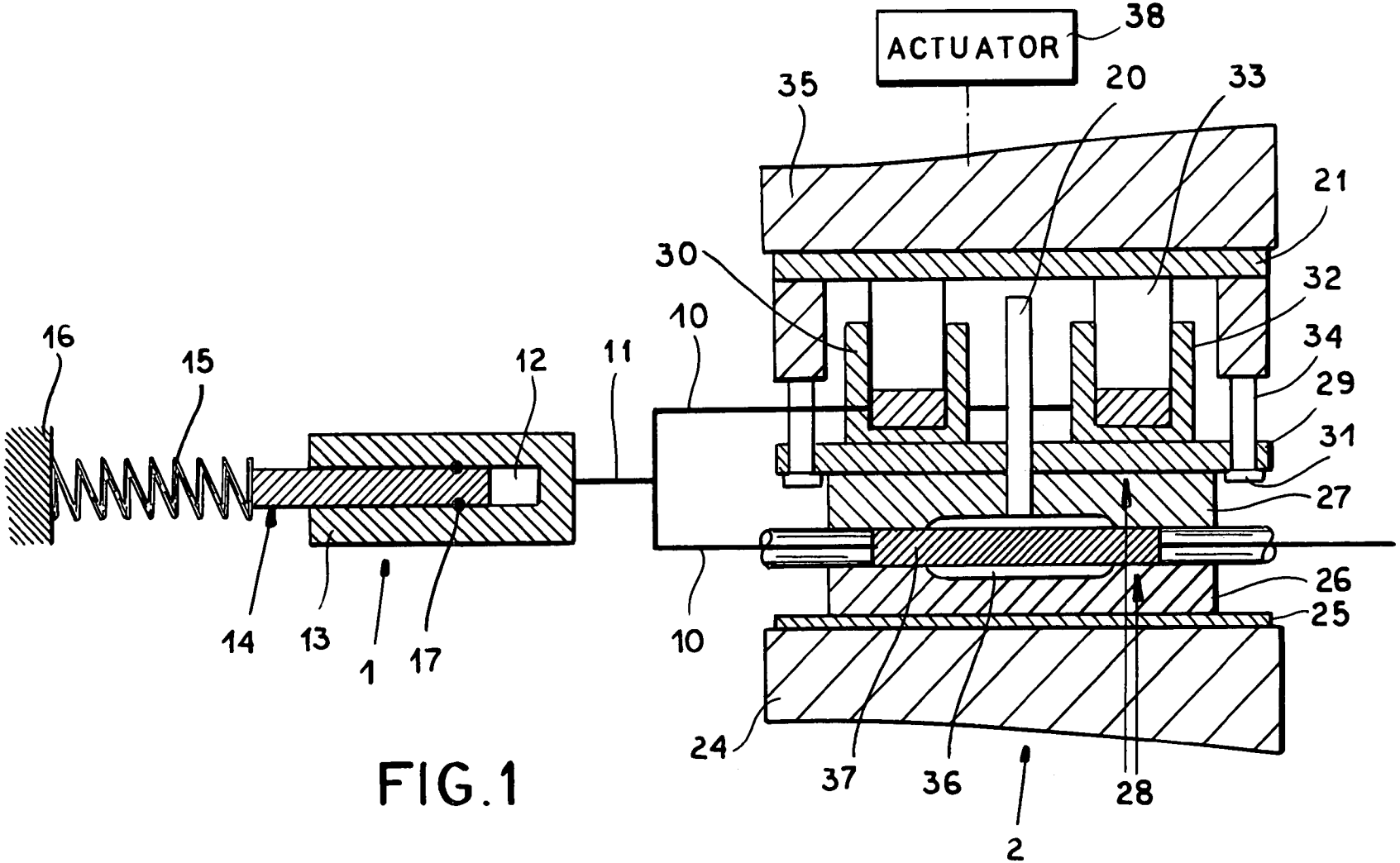
FIG. 1 is a schematic view of the high-pressure shaping system according to the invention.

As seen in FIG. 1, a mechanical power crank-type press 2 has a die assembly 28 comprising a lower die 26 and an upper die 27. The lower die 26 is mounted on a bed 24 of the press 2 such that it can be detached, and a die plate 25 is provided between the press bed 24 and the lower die 26. The upper die 27 is connected with cylinders 32 of piston-cylinder units 30 by a cylinder plate 29. Pistons 33 of the piston-cylinder-units 30 are connected with a press ram 35 vertically shifted by an actuator 38 of the mechanical press 2 by a piston plate 21 such that it can be detached. The cylinder plate 29 carries rod-type return units 34 for the piston-cylinder units 30. Free ends of the restoring means 34 are provided with entrainment heads 31.

A schematically illustrated hydraulic line conduit or 11 extends between a piston-cylinder-spring-unit 1 and the die assembly 28. The line 11 allows, due to its particular design, the piston-cylinder-spring-unit 1 to move relative to the die assembly 28. Thus with two piston-cylinder-units 30 in total which contain a hydraulic fluid the die assembly 28 can be connected with a press ram 35 of a mechanical press 2 formed as a crank press such that it can be moved. The device 20 for additional manufacturing operations applies pressure on the workpiece 37 during or after internal high pressure shaping by means of the press stroke of the press ram 35.

A pressure control system is composed of the piston-cylinder-spring unit 1 according to the invention. The medium is stored under high pressure in a high-pressure chamber 12 of the piston-cylinder-spring-unit 1. The high-pressure chamber 12 is formed by a cylinder 13, a piston 14 and a seal 17. The fluid which has to be displaced is maintained under high pressure in of the conduits 10 and 11 and in the high-pressure chamber 12 of the piston-cylinder-spring-unit 1. The force applied to the piston 14 of the piston-cylinder-spring-unit 1 by means of the pressure is countered by a spring 15 and a spring support 16.

The piston-cylinder-spring unit 1 shapes a workpiece 37 with the mechanical power press 2. To assure complete shaping of the workpiece 37 which has to be shaped in a shaping chamber 36 of the die assembly 28, the volume displaced by the piston-cylinder-units 30 has to be larger than the volume which would be necessary for shaping, that is more than the interior of the workpiece 37 can hold. The displaced excess volume is directed to the high-pressure chamber 12. The piston 14 of the piston-cylinder-spring-unit 1 moves to the left. The pressing time increases. Thus, an additional fabrication operation with a further device 20 is possible. Subsequently, the press ram 35 moves further downward toward the upper dead center position OT, and the excess fluid is directed through the lines 10 and 11 from the high-pressure chamber 12 toward the piston-cylinder-unit 30 of the press 2. The pressure decreases and the press 2 opens the die assembly 28.

Figure 2:
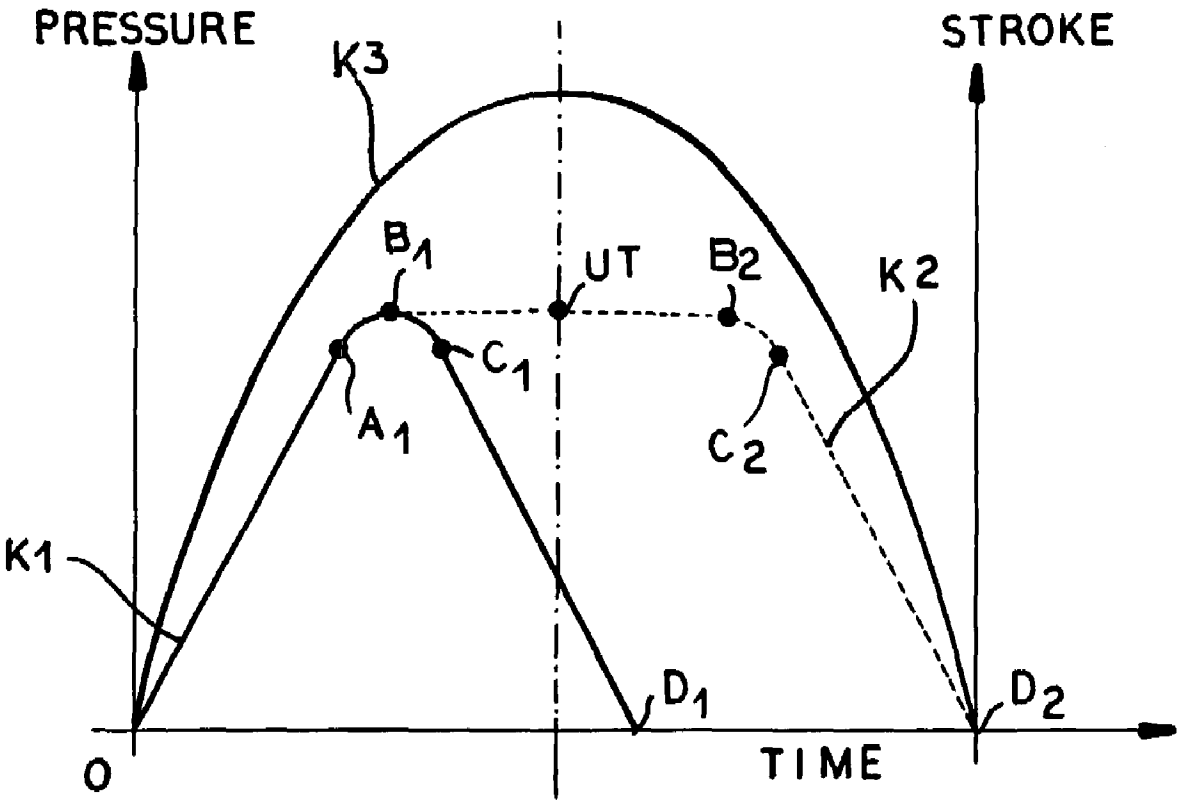
FIG. 2 is a diagram illustrating operation of the system of FIG. 1.

FIG. 2 shows a diagram wherein the y-axis illustrates the pressure and the stroke of the press 2 as a function of time illustrated on the x-axis.

The curve K1 illustrates the curve of a prior-art press with an electronic or hydraulic pressure control system for hydroshaping. Pressure starts to increase at zero on the pressure axis when the dies 26 and 27 close and passes via the operating point $A_1$, at which deformation of the workpiece 37 starts, of the internal high-pressure shaping process until the lower dead center $B_1$ of the curve K1. Once the press stroke has reached the lower dead center $B_1$, the press ram moves upward toward the unillustrated upper dead center OT, so the pressure decreases and passes through points $C_1$ and $D_1$. Pressure in the workpiece drops through $C_1$, by which time the deformation should be set plastically in the workpiece 37. The press opens up after the point $D_1$. Upper dead center OT, which is not illustrated, is passed without any time delay.

The curve K2 shows the pressure of the press 2 according to the invention over the pressure plateau $B_1$-$B_2$ that is built up by the countervailing force of the spring 15 of the pressure control system 1. The height of the pressure curve K2 depends on the spring constant. The countervailing force of the spring support 16 prevents the pressure from dropping and builds up the pressure level $B_1$-$B_2$ the central point of which is the lower dead center UT of the stroke of the press ram 35. Within the time between pressure points $B_1$ and $B_2$, additional manufacturing operations are carried out. The pressure build-up starts at zero on the pressure axis and increases, passing the operating point $A_1$ of the internal high pressure shaping process until a maximal value at the bottom dead center UT of the press stroke is reached. The pressure maximum at the bottom dead center UT which can be achieved is a function of the spring constant. This pressure is maintained in the entire system by the piston-cylinder-spring-unit 1 until the point $B_2$ is reached.

The ram-movement curve K3 is a reference curve for the pressure curve K2. This reference curve K3 shows the stroke or position of the press ram 35 as a function of time.

I claim:

1. A high-pressure system for hydroshaping a hollow workpiece having an interior, the system comprising:

a lower die;

an upper die vertically shiftable above the lower die between a lower closed position engaging the lower die and forming therewith a cavity shaped to hold the workpiece and an upper open position spaced above the lower die;

an upper actuating element above the upper die;

a vertically compressible hydraulic operating cylinder braced between the upper die and the actuating element;

a spring-loaded pressure-storing cylinder having a chamber;

a hydraulic line connected between the operating cylinder, the chamber of the pressure-storing cylinder, and the interior of the workpiece;

means for downwardly shifting the actuating element and thereby first closing the dies together, then pressurizing the interior of the workpiece via the line from the operating cylinder such that the workpiece deforms and shapes itself to the cavity, and then filling the chamber of the spring-loaded pressure-storing cylinder, and for thereafter upwardly shifting the actuating element, whereby at first the actuating element travels upward without upward travel of the upper die as the pressure-storing cylinder empties, and then the upper die is entrained upward off the workpiece by the actuating element; and a tool mounted on one of the dies and engageable with the workpiece when the dies are closed.

2. The hydroshaping system defined in claim 1 wherein the tool is operable by the actuating element after the dies are in the closed position.

3. The hydroshaping system defined in claim 1 wherein the tool is a punch engaged through the upper die.

4. The hydroshaping system defined in claim 1 wherein the means downwardly shifts the actuating element after the dies are in the closed position.

5. The hydroshaping system defined in claim 1 wherein the operating cylinder pumps out a volume of liquid on downward shifting of the actuating element that is substantially greater than a volume of the workpiece.

* * * * *